US005632287A

United States Patent [19]

Hayworth et al.

[11] Patent Number: 5,632,287

[45] Date of Patent: May 27, 1997

[54] FLAT SMOKING ARTICLE AND METHOD OF MAKING SAME

[75] Inventors: Roger G. Hayworth, High Point; Jackie L. White, Pfafftown, both of N.C.

[73] Assignee: R. J. Reynolds Tobacco Company, Winston-Salem, N.C.

[21] Appl. No.: 567,392

[22] Filed: Dec. 1, 1995

[51] Int. Cl.[6] ..... A24D 1/00; A24D 1/02

[52] U.S. Cl. ..... 131/360; 131/353; 131/358; 131/364; 131/365

[58] Field of Search ..... 131/329, 353, 131/358, 360, 364, 367, 365

[56] References Cited

U.S. PATENT DOCUMENTS

| | | | |
|---|---|---|---|
| H1271 | 1/1994 | Shouse | 131/360 X |
| 251,340 | 12/1881 | Ginter . | |
| D. 267,121 | 11/1982 | Min . | |
| 579,421 | 3/1897 | Campbell | 131/360 |
| 582,265 | 5/1897 | Campbell | 131/360 |
| 582,266 | 5/1897 | Campbell . | |
| 725,671 | 4/1903 | Butler . | |
| 1,104,779 | 7/1914 | Cooley . | |
| 3,230,958 | 1/1966 | Dearsley | 131/364 |
| 3,244,182 | 4/1966 | Eissmann | 131/364 X |
| 3,385,302 | 5/1968 | Wattenford . | |
| 4,047,536 | 9/1977 | Asfour . | |
| 4,651,756 | 3/1987 | Luke et al. | 131/284 X |
| 4,766,911 | 8/1988 | Oglesby | 131/284 X |
| 5,016,656 | 5/1991 | McMurtrie . | |
| 5,462,073 | 10/1995 | Bowen et al. | 131/358 X |

FOREIGN PATENT DOCUMENTS

| | | | |
|---|---|---|---|
| 0158752 | 9/1954 | Australia | 131/365 |
| 0721080 | 11/1965 | Canada | 131/353 |
| 0064132 | 11/1982 | European Pat. Off. | 131/329 |
| 0556860 | 8/1932 | Germany | 131/365 |
| 515844 | 12/1939 | United Kingdom | 131/365 |
| 2148690 | 6/1985 | United Kingdom | 131/284 |

*Primary Examiner*—Jennifer Bahr

[57] ABSTRACT

A smoking article and methods of making the article are described in which a sheet of reconstituted tobacco having an area less than about 100 $cm^2$ is manually or machine folded into a substantially flat strip of tobacco for smoking. The reconstituted tobacco sheet may be folded about other folded or unfolded strips of tobacco sheet and compressed into a substantially flat smoking article.

46 Claims, 2 Drawing Sheets

FIG. 1
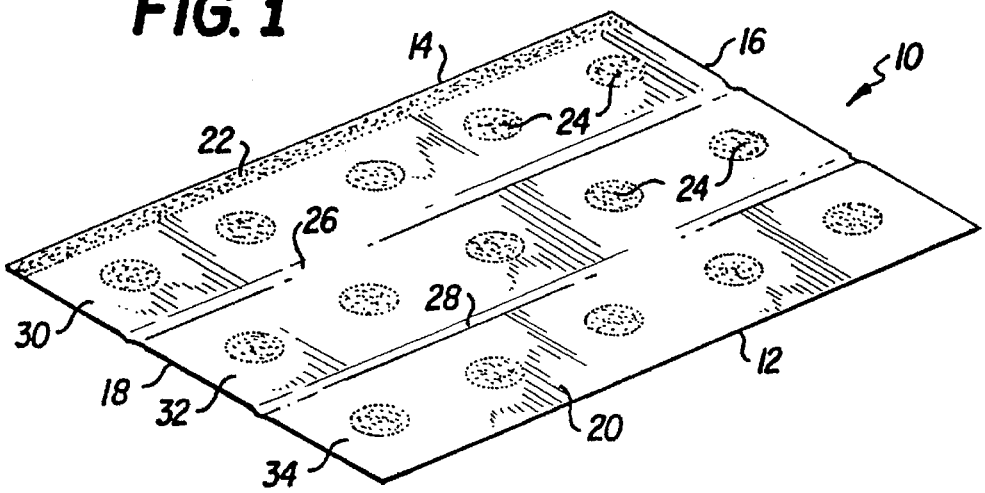
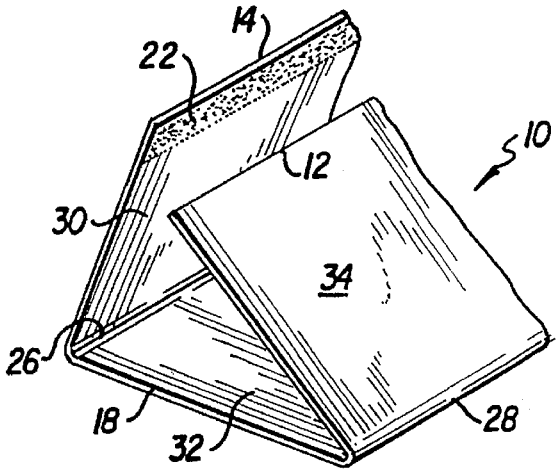
FIG. 2
FIG. 3
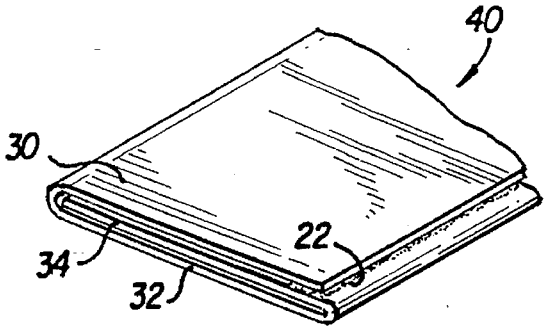
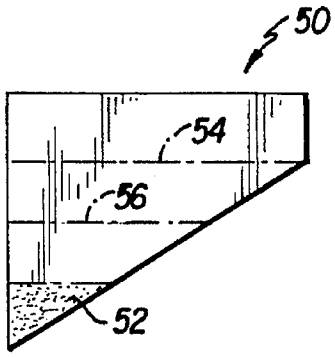
FIG. 4
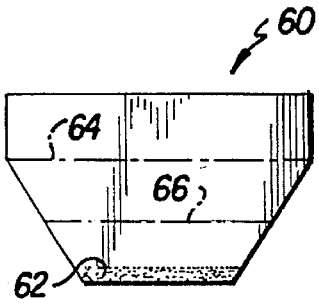
FIG. 5

FLAT SMOKING ARTICLE AND METHOD OF MAKING SAME

FIELD OF THE INVENTION

The present invention relates to smoking articles and methods of making the same and more particularly to smoking articles made substantially entirely of pieces of reconstituted tobacco sheet material and to automated and manual methods of making the smoking articles.

BACKGROUND OF THE INVENTION

One of the earliest forms of a smoking article was a rolled up or twisted tobacco leaf or a portion of a tobacco leaf. Cigars and cigarettes are popular smoking articles that are typically made substantially entirely of tobacco leaf and/or sheets of reconstituted tobacco. Cigarettes are also known which are made of cut filler overwrapped with a reconstituted tobacco sheet so that the cigarette is made substantially entirely of tobacco.

It is also well known for the consumer to form smoking articles from a supply of tobacco filler and individual sheets of cigarette paper having a glue strip along one longitudinal edge thereof for sealing after being moistened by the consumer's tongue. This manual method of forming a smoking article is commonly known as "rolling-your-own." One advantage of the "roll-your-own" type of cigarette is the typically low cost per cigarette as compared to the cost per cigarette of manufactured and packaged filtered and unfiltered cigarettes. The process of making a cigarette according to this method is not easily mastered and often results in cigarettes of non-uniform density and quality.

In the case of the more expensive, manufactured cigarettes, because of governmental regulations and restrictions placed on the use of smoking articles in the workplace, in public areas and the like, it is sometimes not possible for a smoker to consume an entire cigarette. Accordingly, the smoker often extinguishes and discards the cigarette before it is completely consumed, resulting in wasted product and additional cost to the consumer. Relighting a once-extinguished cigarette frequently results in delivery to the smoker of smoke having less than optimum taste.

In view of the foregoing limitations and disadvantages of prior art smoking articles, it would be desirable to provide a smoking article having a substantially lower cost than conventional manufactured cigarettes and cigars. It would also be desirable to provide an inexpensive smoking article which may be conveniently and easily formed into a smoking article by the consumer.

SUMMARY OF THE INVENTION

The present invention is directed to a smoking article and to methods of making the smoking article by mass production and manually. The smoking article comprises one or more sheets of reconstituted tobacco preferably made of relatively high quality tobaccos. The sheet is folded by machine or by the consumer into a substantially flat tobacco strip or stick suitable for smoking. The reconstituted tobacco sheet may include substantially all tobacco, e.g., 55% by weight flue cured tobacco, 30% by weight burley tobacco and 15% by weight of Turkish blend scrap. The sheet may also include constituents to improve foldability, e.g., up to about 20% by weight of wood pulp, or other constituents, such as gums, binders, fillers, etc., to improve the physical characteristics, taste, color or the like of the reconstituted tobacco sheet material. The sheet material preferably has a total cross-sectional area of less than about 100 $cm^2$. Compared to a conventional cigarette having a draw resistance of about 60 mm water to about 130 mm water, the smoking article of the invention has a draw resistance of less than about 25 mm of water, preferably a draw resistance in the range of about 1 to 20 mm of water, and most preferably a draw resistance in the range of about 3 to 15 mm of water.

In a first embodiment of the invention suitable for manually forming a smoking article, a relatively small area base sheet of reconstituted tobacco is provided with an adhesive, such as a water soluble adhesive, on one side thereof. The base sheet is manually folded one or more times to form a substantially flat smoking article and the adhesive is moistened or otherwise activated to retain the sheet in its folded condition. Two or more sheets may be folded together for a longer burning smoking article.

The size and shape of the base sheet for the first embodiment may vary. In one form, the sheet is rectangular having an area of about 18 $cm^2$ to about 100 $cm^2$ with a length or longitudinal dimension of about 6 cm to about 10 cm and a width or transverse dimension of about 3 cm to about 10 cm. A strip of water soluble adhesive is provided on one surface of the sheet or along one longitudinal edge thereof. For a base sheet with an area of about 18 $cm^2$, the sheet is preferably folded twice longitudinally to form a substantially flat smoking article having three approximately 1 cm by 6 cm layers or panels of reconstituted tobacco. The adhesive strip is moistened, e.g., by the consumer's tongue, and pressed against a confronting surface of the sheet to secure the sheet in a folded condition suitable for smoking.

In another form, the base sheet may be generally triangular with an adhesive applied to one surface or to an area adjacent one apex of the triangular sheet. Such a sheet is preferably folded toward the apex having the adhesive area so that the sheet can be secured in a substantially flat, folded condition. Other suitable shapes and sizes for the base sheet will be apparent to those skilled in the art, e.g., trapezoidal, circular, etc.

The adhesive applied to the sheet is preferably a water soluble adhesive, such as dextrin or a starch-based glue similar to the adhesives used for the cigarette paper of a "roll-your-own" cigarette. The adhesive may also be a contact-type or pressure-sensitive adhesive provided with a peelable protective sheet. A narrow adhesive strip may be applied to one longitudinal edge of the base sheet, but the adhesive may also be applied to substantially the entire surface area of one side of the sheet or in a plurality of areas on one side of the sheet. Advantageously, when the adhesive is applied to substantially the entire surface area of the sheet, the folded smoking article will remain in a flatter condition and can provide a greater draw resistance.

The base sheets of the first embodiment may be packaged in stacks of unfolded sheets, one above another in a manner similar to a deck of cards or in a manner similar to conventional "roll-your-own" cigarette papers. The pack may be overwrapped with any suitable packaging material, such as the packaging material for conventional cigarettes. The base sheets may comprise a strip formed in a roll with either longitudinal or transverse perforations for separating individual sheets from the strip and may be packaged in various ways to facilitate dispensing and removal of individual sheets. If desired, an individual sheet may be creased, crimped or weakened along longitudinal lines to facilitate folding of the sheet into a smoking article.

In the second embodiment of the invention, one or more narrow, continuous strips of a reconstituted sheet of tobacco are combined together on automatic apparatus with at least the outermost sheet folded and adhesively bonded together with a longitudinal edge to form a continuous, substantially flat strip or rod which may then be cut into suitable lengths for smoking. If more than one strip is used, the innermost strip or strips are used as a tobacco filler and may be either folded or gathered or slit into narrower width sheets and overlapped. The folded, gathered or overlapped sheets are then guided into the outermost folded sheet to form the substantially flat continuous strip. The thickness of the folded flat strip may vary but is typically less than about 6 mm thick and preferably is about 2 mm to about 4 mm thick.

Advantageously, the smoking article of the present invention is made substantially entirely of reconstituted tobacco sheet material with no filter or cigarette paper overwrap. Consequently, the smoking article of the invention is substantially completely biodegradable and is economically manufactured for a relatively low cost to the consumer.

The reconstituted tobacco sheet material may be treated with tobacco dust, densified tobacco particles, tobacco leaf particles or tobacco extract to improve the taste characteristics of the smoking article. The smoking article can be selectively made with a certain mass of reconstituted tobacco, preferably from about 0.10 gm to about 1.0 gm, to provide from about two to nine or more puffs to the smoker. The draw resistance of the smoking article will vary depending on, among other things, the number of layers in the smoking article, whether it is formed manually or by machine, the pressure applied to flatten the folded sheets, the amount, location and type of adhesive applied to the smoking article, etc. Draw resistance is typically less than about 25 mm of water.

With the foregoing and other objectives, features and advantages of the invention that will become hereinafter apparent, the invention may be more clearly understood by reference to the following detailed description of the invention, the appended claims and the several views illustrated in the attached drawings.

BRIEF DESCRIPTION OF THE DRAWINGS

FIG. 1 is a perspective view of a base sheet of reconstituted tobacco used to make the first embodiment of the smoking article of the invention;

FIG. 2 is a perspective view of the sheet of FIG. 1 partially folded into a smoking article;

FIG. 3 is a perspective view of the sheet of FIG. 1 folded and secured into a substantially flat smoking article;

FIG. 4 is a top plan view showing a substantially triangular form of a base sheet of reconstituted tobacco used to make a smoking article of the invention;

FIG. 5 is a top plan view showing a substantially trapezoidal form of a base sheet of reconstituted tobacco used to make a smoking article of the invention;

DETAILED DESCRIPTION OF THE INVENTION

Figure 7:
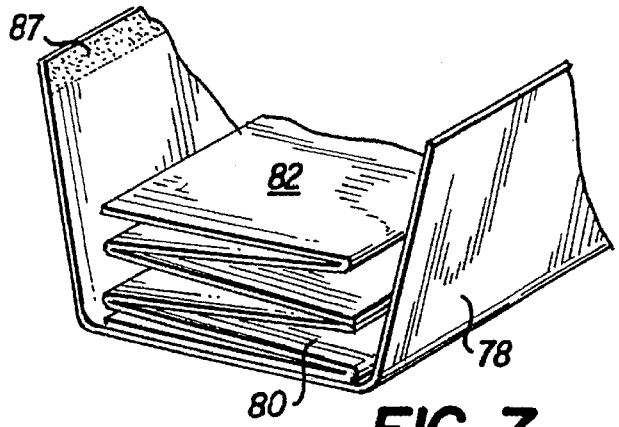
FIG. 7 is a cross-sectional end view taken along line A—A of FIG. 6 of one form of partially folded reconstituted tobacco sheets of the second embodiment.
Figure 8:
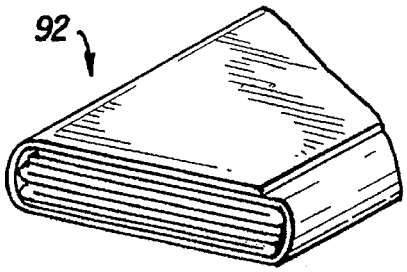
FIG. 8 is a cross-sectional end view taken along line B—B of FIG. 6 of the sheets of FIG. 7 shown completely folded and secured into a smoking article of the present invention.

Referring to FIG. 1 of the drawings, a first embodiment of the invention is shown as a base sheet of reconstituted tobacco designated generally with reference numeral 10. Base sheet 10 is preferably made of relatively high quality tobaccos, but may be made using typical constituents of reconstituted tobacco sheet particularly if it is folded about higher quality tobacco strips or folded sheet as described hereinafter.

Base sheet 10 may be of any suitable shape and size, but preferably is rectangular with a surface area of between about 10 $cm^2$ to about 100 $cm^2$, e.g., 5 cm ×2 cm, 6 cm×3 cm, 10 cm×10 cm, etc. Sheet 10 has two longitudinal edges 12, 14 and two transverse edges 16, 18. A water soluble adhesive, such as dextrin, is applied to one surface of the sheet 10 over the entire, or substantially entire, surface of one side 20 or in a narrow strip 22 along an edge 14 of the sheet 10. The adhesive could also be applied by printing "dots" or spaced adhesive areas 24 as shown in dashed lines on side 20 of the sheet 10. The areas 24 may be of any suitable shape, e.g., strips, circular, etc. If desked, the base sheet 10 may be creased, crimped or weakened along lines 26, 28 parallel to the longitudinal edges 12, 14 as shown to facilitate folding of the base sheet 10 into a flat folded strip having three layers or panels 30, 32, 34 as described hereinafter.

FIG. 2 illustrates a base sheet 10 in a partially folded condition in which panel 34 is manually folded along line 28 onto panel 32 and panel 30 is thereafter folded along line 26 onto panel 34. Prior to folding the sheet 10, the water soluble adhesive strip 22 (or adhesive areas 24) is moistened, e.g., by the consumer's tongue. When the panels 34 and 30 are folded to their final position shown in FIG. 3, the moistened adhesive strip 22 (or adhesive areas 24) will secure the panels 30, 32, 34 together into the substantially flat smoking article 40 of FIG. 3. Advantageously, if adhesive areas 24 are used instead of, or in addition to, strip 22, the panels 30, 32, 34 will be secured in more intimate contact, thus increasing the draw resistance of the smoking article 40.

FIG. 4 illustrates another form of the first embodiment of the invention wherein a reconstituted tobacco base sheet 50 is formed in a generally triangular shape with an adhesive area 52 disposed at one apex of the triangle. The sheet 50 is folded over along lines 54 and 56 consecutively, then adhesive area 52 is moistened and pressed against the sheet to secure the folded sheet into a substantially flat smoking article similar to that shown in FIG. 3.

FIG. 5 shows another form of the first embodiment of the invention in which a reconstituted tobacco base sheet 60 is formed into a generally trapezoidal shape with an adhesive area or strip 62 disposed along the shorter side of the trapezoid. Sheet 60 is folded along lines 64, 66 consecutively, then adhesive area 62 is moistened and pressed against the sheet to form a substantially flat smoking article similar to that of FIG. 3. As in the embodiment of FIG. 1, the adhesive areas 52, 62 may be a plurality of spaced areas on one side of the sheets 50, 60, respectively, or the adhesive may cover the entire surface of one side of the sheets 50, 60.

Figure 6:
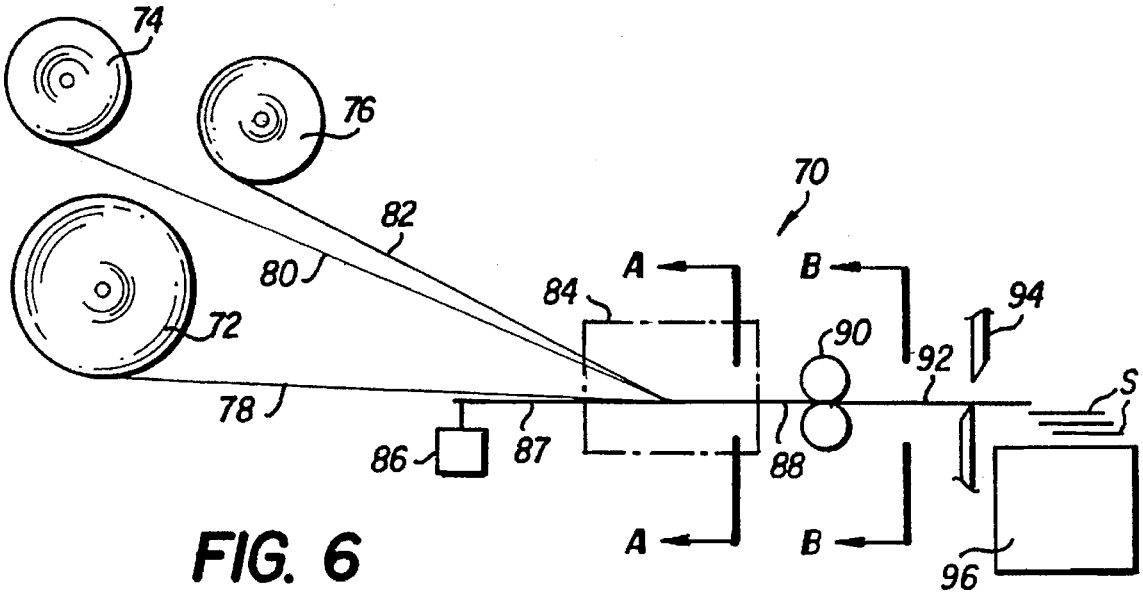
FIG. 6 is a schematic view of an apparatus which may be used to mass produce smoking articles according to a second embodiment of the present invention.

Now referring to FIGS. 6–10, the second embodiment of the invention will be described. FIG. 6 is a schematic of an apparatus 70 that may be used to make a continuous strip or flat rod from which the substantially flat smoking articles of the invention are cut. Apparatus 70 comprises a plurality of spools 72, 74, 76 of reconstituted tobacco strips 78, 80, 82 which are supplied from the spools 72, 74, 76 to a folding and combining station 84 where the strip 78 is combined with and folded around strips 80, 82 to form the outermost wrap of the continuous rod 88.

An adhesive applicator 86 is located upstream of folding and combining station 84 for applying an adhesive strip 87, such as a hot melt adhesive, to a longitudinal edge of the reconstituted tobacco strip 78. As the strips 78, 80, 82 are brought together at station 84, the strip 78 forms the outermost wrap which is adhesively bonded about strips 80 and 82 and then compressed by a pinch roll pair 90 located downstream of station 84 into a substantially flat strip 92 which is cut by a cutting mechanism 94 into appropriate lengths suitable for use as smoking articles S. After compression, the flat strip 92 has a thickness of less than about 6 mm and preferably a thickness of about 2 mm to about 4 mm with a draw resistance of less than about 25 mm of water, preferably in the range of about 1 to about 20mm of water, and most preferably about 3 to about 15 mm of water, and a weight from about 0.10 gm to about 1.0 gm. Smoking articles S are conveyed to a packaging means 96 where they are suitably packaged for distribution and sale.

Figure 9:
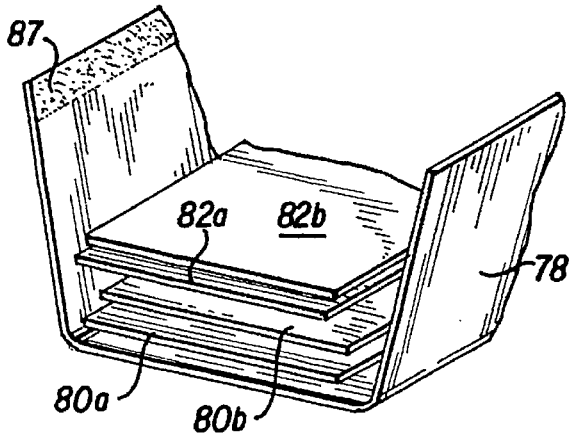
FIG. 9 is a cross-sectional end view taken along line A—A of FIG. 6 of another form of partially folded reconstituted tobacco sheets of the second embodiment.

Optionally, the apparatus 70 may be provided with a slitter 83 shown in dashed lines in FIG. 6 for longitudinally slitting one or both of the strips 80, 82 into two or more individual strips. After slitting, the strips are preferably guided into overlapping relation as shown in FIG. 9 by means of a guide 85 also shown in dashed lines in FIG. 6. If the inner strip is gathered, only one of inner strips 80, 82 will be required and such strip may be gathered by a conventional gathering device (not shown) disposed between the spool 74 or 76 and the folding and combining station 84.

Indicia, such as brand name information, a product logo or the like, may be applied to the flat strip 92 at spaced intervals corresponding to each smoking article S. If desired, such indicia may be applied in lieu of printing with ink, for example, by a heated tool 91 in the manner of "branding."

FIGS. 7–8 and 9–10 illustrate two forms of smoking articles S that may be manufactured using apparatus such as apparatus 70. FIG. 7 shows a cross-section of the strips 78, 80, 82 taken along line A—A in FIG. 6 during the folding and combining of the strips. Strips 80, 82 are supplied from spools 74, 76 in a folded condition or are folded after being payed off spools 74, 76 and are guided into the pocket formed by the folding of outermost strip 78. As the strips continue through station 84, the strip 78 is folded around the strips 80, 82 and secured by the adhesive strip 87 when the combined rod 88 is passed through the pinch rolls 90. When the rod 88 passes through pinch rolls 90, it is compressed into a substantially flat continuous strip 92 as shown in the cross-section of FIG. 8 which is taken along line B—B of FIG. 6. Thereafter, strip 92 passes through the cutter 94 where it is cut into individual smoking articles S and conveyed to packaging apparatus 96.

Figure 10:
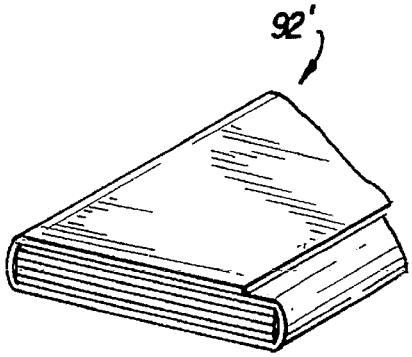
FIG. 10 is a cross-sectional end view taken along line B—B of FIG. 6 of the sheets of FIG. 9 shown completely folded and secured into a smoking article of the present invention.

FIGS. 9 and 10 illustrate another form of the second embodiment of the invention wherein the strips 80, 82 comprise a plurality of individual flat strips 80*a*, 80*b* and 82*a*, 82*b*, respectively. The flat strips 80*a*, 80*b*, 82*a*, 82*b* may be provided from individual spools or may be slit from strips 80, 82 as described above and are combined inside the outermost strip 78 which is folded over and bonded with adhesive strip 87 to form the substantially flat strip 92' shown in FIG. 10.

Other equivalent embodiments of the smoking article of the invention will be apparent to those skilled in the art in view of the teachings herein. For instance, two or more folded strips 78 may be used instead of one and more than two strips 80, 82 may be used in the second embodiment. The first embodiment of the smoking article, with a single sheet as shown in FIG. 1 may also be made on the apparatus of FIG. 6.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A sheet of reconstituted tobacco for use in making a smoking article, said sheet having two sides, said sheet having a first fold line defining at least first and second panels, and an adhesive applied to a surface of both the first and second panels on one side of said sheet such that when said sheet is folded upon itself along said first fold line, the adhesive on each panel contacts the surface of the other panel to thereby adhesively secure the panels in direct surface contact with one another to form a substantially flat smoking article.

2. The sheet of claim 1, wherein said sheet has a rectangular periphery and a surface area of less than about 100 $cm^2$.

3. The sheet of claim 2, wherein said sheet has longitudinal edges, said adhesive being applied along at least one longitudinal edge of said sheet.

4. The sheet of claim 1, wherein said adhesive is applied over the entire surface area of said one side of said sheet.

5. The sheet of claim 1, wherein said adhesive is a moisture-activated adhesive.

6. The sheet of claim 1, wherein said sheet has a perimeter comprising one of rectangular, triangular, trapezoidal and circular and a surface area of less than about 100 $cm^2$.

7. The sheet of claim 1, wherein said sheet has a second fold line defining a third panel adjacent to said second panel, said adhesive being applied to the third panel on said one side of said sheet such that when said third panel is folded along said second fold line over said first panel, the adhesive on said third panel contacts the surface of said first panel to thereby adhesively secure the third panel in direct surface contact with said first panel.

8. The sheet of claim 7, wherein said third panel has a free longitudinal edge, an adhesive strip applied to said third panel on said one side of said sheet along said free longitudinal edge of said third panel, said adhesive strip adhesively securing the free longitudinal edge of the third panel to said first panel.

9. The sheet of claim 7, wherein the adhesive is applied in spaced, discrete locations to the surfaces of said first, second and third panels on said one side of said sheet.

10. A method of making a smoking article comprising the steps of:

providing a sheet of reconstituted tobacco having a given area;

folding said sheet onto itself along at least one fold line to define at least two panels of said sheet, said panels having inner and outer surfaces; and pressing an inner surface of one of said panels into contact with the inner surface of another of said panels to form a substantially flat folded smoking article.

11. The method of claim 10, including the step of applying an adhesive to said sheet of reconstituted tobacco in a region confronting an area of said sheet when said sheet is folded, and pressing the adhesive against the area of said sheet confronting the adhesive to secure the sheet into said flat smoking article.

12. The method of claim 10, including the step of folding said sheet along a plurality of fold lines.

13. The method of claim 10, wherein said given area is less than about 100 $cm^2$ and including the step of folding said sheet along a plurality of parallel folded lines.

14. The method of claim 10, including the step of applying indicia to said smoking article with a heated tool.

15. A smoking article comprising:

a sheet of reconstituted tobacco having a given area and a polygonal perimeter with a plurality of edges, said sheet being folded at least once along a first fold line into contact with itself to form a flat folded strip, said fold line being substantially parallel to an edge of said polygonal perimeter; and adhesive means applied to said reconstituted tobacco sheet for adhesively securing said sheet to itself in said flat folded strip.

16. The smoking article of claim 15, wherein said given area is less than about 100 $cm^2$.

17. The smoking article of claim 15, wherein said polygonal perimeter is rectangular, said adhesive means comprising a moisture activated adhesive applied to the surface of one side of said sheet.

18. The smoking article of claim 17, where said adhesive is applied over the entire surface of said one side of said sheet.

19. The smoking article of claim 15, wherein said adhesive is applied only along an edge of said sheet.

20. The smoking article of claim 15, wherein the draw resistance of said smoking article is less than about 25 mm of water.

21. The smoking article of claim 20, wherein the draw resistance is in the range of about 1 to about 20 mm of water.

22. The smoking article of claim 20, wherein the draw resistance is in the range of about 3 to about 15 mm of water.

23. The smoking article of claim 15, wherein the weight of said smoking article is from about 0.1 gm to about 1.0 gm.

24. The smoking article of claim 15, wherein the thickness of said folded strip is less than about 6 mm.

25. The smoking article of claim 24, wherein the thickness of said folded strip is about 2 mm to about 4 mm.

26. A method of making a smoking article comprising the steps of:

providing a first sheet of reconstituted tobacco having a given area;

placing a second sheet of reconstituted tobacco onto said first sheet; and folding said first sheet along at least a first fold line so as to enclose said second sheet within said first sheet with said first and second sheets in substantially parallel planes with respect to one another to thereby form a substantially flat smoking article.

27. The method of claim 26, including the step of folding said first sheet along a second fold line to enclose said second sheet within said first sheet.

28. The method of claim 27, including the step of placing a plurality of second sheets of reconstituted tobacco onto said first sheet in a stacked relationship.

29. The method of claim 28, wherein at least one of said plurality of second sheets of reconstituted tobacco is folded along at least one fold line.

30. The method of claim 26, including the step of folding said second sheet along at least one fold line.

31. The method of claim 30, including the step of placing a plurality of folded second sheets of reconstituted tobacco onto said first sheet in a stacked relationship.

32. A method of making a smoking article comprising the steps of:

feeding a first elongated strip of reconstituted tobacco to a folding apparatus;

folding said first strip of reconstituted tobacco along first and second longitudinal fold lines to form at least three longitudinal panels of said sheet defined by said fold lines; and pressing said panels together in substantially parallel planes with respect to one another to form a substantially flat folded smoking article.

33. The method of claim 32, including the step of, prior to said pressing step, feeding a second elongated strip of reconstituted tobacco onto said first strip of reconstituted tobacco.

34. The method of claim 33, including the step of folding said second strip along at least one longitudinal fold line.

35. The method of claim 33, including the steps of longitudinally slitting said second strip of reconstituted tobacco into at least two strips and overlapping said two strips in stacked relation to one another.

36. A smoking article made according to the process comprising the steps of:

providing a first sheet of reconstituted tobacco having a given area;

placing a second sheet of reconstituted tobacco onto said first sheet; and folding said first sheet along at least a first fold line so as to enclose said second sheet within said first sheet with said first and second sheets in substantially parallel planes with respect to one another to thereby form a substantially flat smoking article.

37. The smoking article of claim 36, including the step of folding said first sheet along a second fold line to enclose said second sheet within said first sheet.

38. The smoking article of claim 37, including the step of placing a plurality of second sheets of reconstituted tobacco onto said first sheet in a stacked relationship.

39. The smoking article of claim 38, wherein at least one of said plurality of second sheets of reconstituted tobacco is folded along at least one fold line.

40. The smoking article of claim 36, including the step of folding said second sheet along at least one fold line.

41. The smoking article of claim 40, including the step of placing a plurality of folded second sheets of reconstituted tobacco onto said first sheet in a stacked relationship.

42. A smoking article comprising:

a sheet of reconstituted tobacco, said sheet being folded at least once along a first fold line to define at least two substantially planar panels; and at least one substantially planar strip of tobacco located between said two panels such that said strip and said panels are disposed in substantially parallel planes with respect to one another to form a substantially flat smoking article.

43. The smoking article of claim 42, wherein said sheet is folded along a second fold line to enclose said strip within said sheet.

44. The smoking article of claim 42, wherein said strip is folded along at least one fold line.

45. The smoking article of claim 42, including a plurality of said strips of tobacco disposed between the panels of said first sheet in a stacked relationship.

46. The smoking article of claim 45, wherein at least one of said plurality of strips of tobacco is folded along at least one fold line.

* * * * *